US008117872B2

(12) United States Patent
Jeong

(10) Patent No.: US 8,117,872 B2
(45) Date of Patent: Feb. 21, 2012

(54) SIGNAL INSPECTION APPARATUS OF COMMERCIAL WASHING MACHINE

(75) Inventor: Ji An Jeong, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 960 days.

(21) Appl. No.: 12/037,601

(22) Filed: Feb. 26, 2008

(65) Prior Publication Data

US 2008/0250821 A1 Oct. 16, 2008

(30) Foreign Application Priority Data

Feb. 26, 2007 (KR) ..... 10-2007-0019035

(51) Int. Cl.
*D06F 33/02* (2006.01)

(52) U.S. Cl. ..... 68/12.27

(58) Field of Classification Search ..... 68/12.02, 68/12.16, 12.23, 12.27; 194/205, 239, 244
See application file for complete search history.

(56) References Cited

U.S. PATENT DOCUMENTS 3,012,428 A * 12/1961 Lewis et al. ..... 68/12.23
3,110,384 A * 11/1963 Rub ..... 194/217
4,493,410 A * 1/1985 Nelson ..... 194/241
5,585,704 A * 12/1996 Elzind ..... 318/446
5,859,778 A * 1/1999 Kuroda et al. ..... 700/169

* cited by examiner

*Primary Examiner* — Joseph L Perrin
(74) *Attorney, Agent, or Firm* — Birch, Stewart, Kolasch & Birch, LLP

(57) ABSTRACT

A signal inspection apparatus of a commercial washing machine that is capable of inspecting whether a signal generated from the commercial washing machine is abnormal is disclosed. The signal inspection apparatus includes a connector configured to be connected to ports of a machine body of the commercial washing machine, through which the exchange of a signal between the machine body and a charge settlement device is achieved, and a display unit for displaying whether the signal inputted through the ports is abnormal.

3 Claims, 3 Drawing Sheets

SIGNAL INSPECTION APPARATUS OF COMMERCIAL WASHING MACHINE

CROSS-REFERENCE TO RELATED APPLICATION

This application claims the benefit of Korean Patent Application No. 10-2007-0019035, filed on Feb. 26, 2007, which is hereby incorporated by reference in its entirety as if fully set forth herein.

BACKGROUND OF THE INVENTION

1. Field of the Invention

The present invention relates to a washing machine, and more particularly, to a commercial washing machine that requires the public to pay charges necessary to use the commercial washing machine.

2. Discussion of the Related Art

Generally, a laundry machine is a machine that cleans clothes and bedclothes (hereinafter, referred to as "laundry") through various processes, such as washing, rinsing, spin-drying, and drying, to remove contaminant from the laundry. Representative examples of the laundry machine include a washing machine and a drying machine.

Based on the purpose of use thereof, the washing machine may be classified as a household washing machine or as a commercial washing machine. The household washing machine is installed in a house for washing laundry belonging to family members residing in the house. On the other hand, the commercial washing machine is installed in a Laundromat for requiring a customer who wishes to wash laundry to pay predetermined charges necessary to use commercial washing machine.

FIG. 1 is a perspective view illustrating the external appearance of a conventional commercial washing machine.

The commercial washing machine includes a machine body 1 forming the external appearance of the washing machine, a tub mounted in the machine body 1 such that the tub is supported by springs and a damper in a shock-absorbing fashion, a drum rotatably mounted in the tub, the drum being provided at the outer circumference thereof with a plurality of water holes, a motor mounted at the rear of the tub for rotating the drum, and a control panel mounted at the front of the machine body 1 for allowing a user to select a function of the washing machine. The control panel includes a main printed circuit board (PCB) for controlling functions of the washing machine. The main PCB includes a power control unit for controlling the supply of power to a drive unit to be allowed or interrupted. Also, the commercial washing machine further includes a charge settlement device 2, such as a coin box for allowing a user to deposit cash, for example a coin, as charges necessary to use the commercial washing machine or a card reader for allowing the user to settle the charges necessary to use the commercial washing machine using a credit card.

The commercial washing machine is installed in a public place such that customers jointly use the commercial washing machine, and therefore, an owner of the commercial washing machine makes a profit. Consequently, the commercial washing machine is designed and manufactured such that the commercial washing machine exhibits higher profit efficiency, stability, maintainability, and durability than the household washing machine.

Specifically, the commercial washing machine further needs a charge settlement device and a control algorithm for the charge settlement device. In addition, the commercial washing machine further needs an additional washing algorithm to maximize the profit of the owner of the commercial washing machine. Furthermore, it is required for the commercial washing machine to be manufactured in a structure in which the commercial washing machine is prevented from being damaged by the customer or components of the commercial washing machine are prevented from being lost by the customer, and, at the same time, the maintenance of the commercial washing machine can be very conveniently and rapidly carried out.

The commercial washing machine is constructed in a structure in which AC power is directly supplied to the machine body 1 Also, the charge settlement device 2 and the machine body 1 are connected to each other via ports such that a control signal related to whether the settlement has been made and the progress of washing can be exchanged between the charge settlement device 2 and the machine body 1.

However, when the machine body and the charge settlement device are separately manufactured, and then the charge settlement device is mounted to the machine body, it is not possible to determine whether a control signal related to the progress of washing is normally generated from the machine body unless the charge settlement device is mounted to the machine body.

Consequently, it is required to mount the charge settlement device at the machine body in order to detect whether the signal from the machine body is abnormal, and, if the signal from the machine body is abnormal, it is required to separate the charge settlement device from the machine body before the machine body is inspected.

SUMMARY OF THE INVENTION

Accordingly, the present invention is directed to a signal inspection apparatus of a commercial washing machine that substantially obviates one or more problems due to limitations and disadvantages of the related art.

An object of the present invention is to provide a commercial washing machine including a charge settlement device having a power control function designed to prevent unnecessary power consumption.

Meanwhile, when the commercial washing machine is constructed in a structure in which the charge settlement device having the power control function is mounted at the commercial washing machine, it is possible to confirm whether a machine body of the commercial washing machine is abnormal only after the charge settlement device is mounted at the commercial washing machine. Consequently, another object of the present invention is to provide a signal inspection apparatus of a commercial washing machine that is capable of inspecting whether a signal generated from the machine body is abnormal before the charge settlement device is mounted at the commercial washing machine.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a signal inspection apparatus of a commercial washing machine includes a connector configured to be connected to ports of a machine body of the commercial washing machine, through which the exchange of a signal between the machine body and a charge settlement device is achieved, and a display unit for displaying whether the signal inputted through the ports is abnormal.

Preferably, the display unit includes a light emitting diode.

Preferably, the display unit outputs a sound.

Preferably, the signal inspection apparatus further includes a resistance element mounted to the connector such that the resistance element is connected in parallel to the display unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
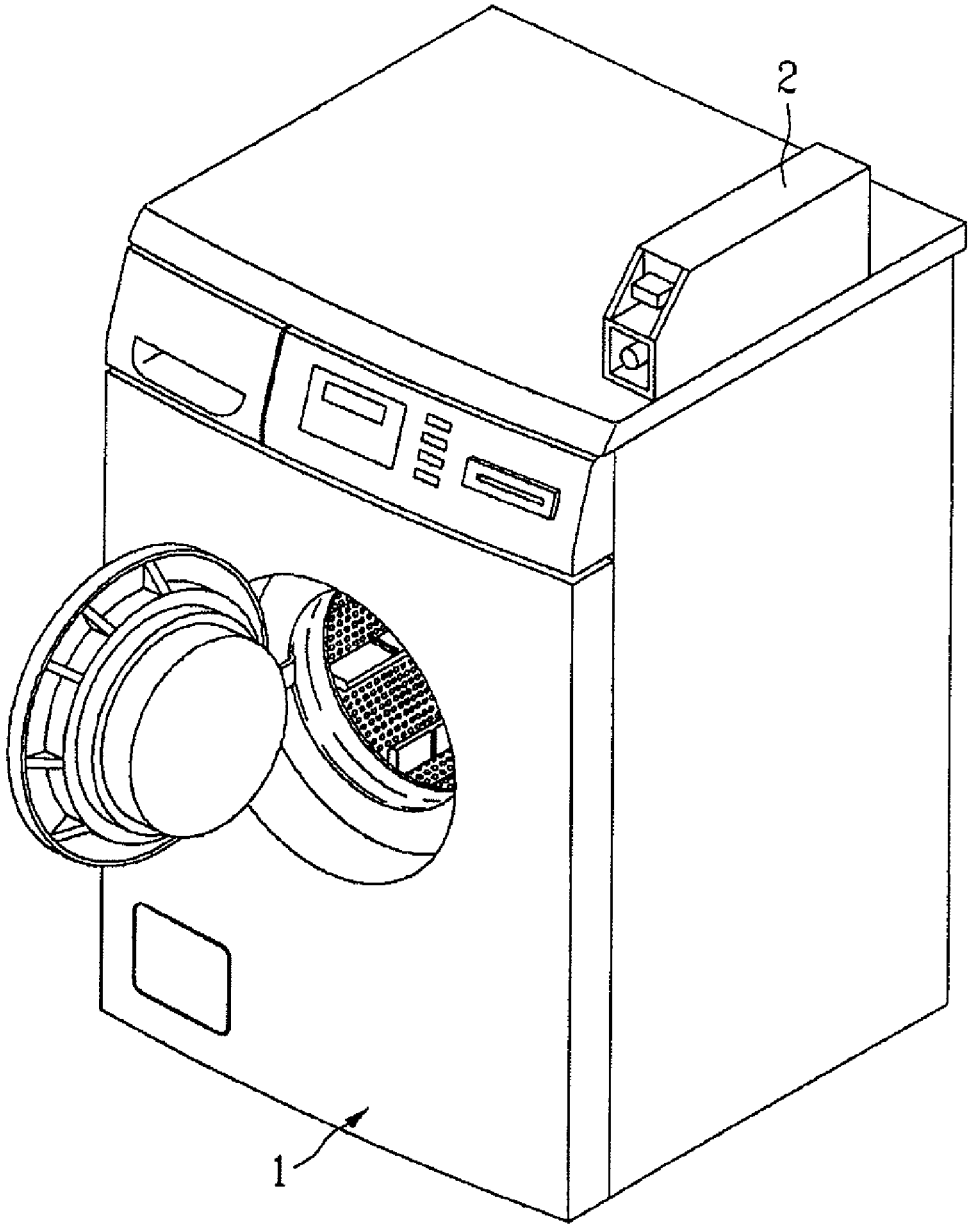
FIG. 1 Prior Art
FIG. 1 is a perspective view illustrating the external appearance of a conventional commercial washing machine.
Figure 2:
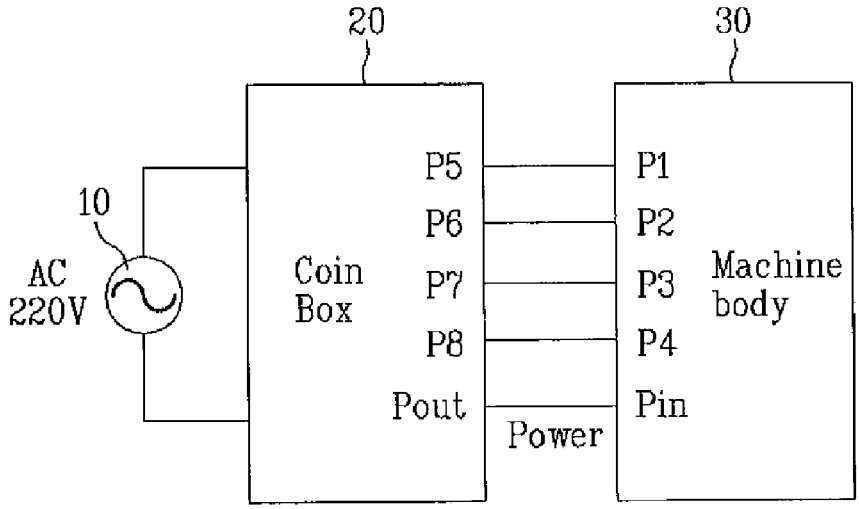
FIG. 2 is a view schematically illustrating the construction of a commercial washing machine according to the present invention.

Hereinafter, the construction of a commercial washing machine according to the present invention will be described with reference to FIG. 2.

The commercial washing machine includes a machine body 30 for performing washing, a charge settlement device 20 for settling charges necessary to operate the machine body 30, and cables (not shown) for connecting the machine body 30 and corresponding ports P5 to P8 of the charge settlement device 20.

The charge settlement device 20 preferably includes a power control unit (not shown) for controlling the supply of power to be allowed or interrupted.

If the power control unit is mounted at the machine body 30 of the commercial washing machine, it is required to continuously supply power to the machine body 30, even when the commercial washing machine is not driven, in order to confirm whether a settlement signal from the charge settlement device 20 is inputted to the machine body 30, with the result that power may be unnecessarily consumed.

Also, only DC current of a low voltage flows through the cables which interconnect the charge settlement device 20 and the power control unit of the machine body 30. For this reason, there is a possibility that the cables may be easily cut, and a signal similar to a the settlement signal may be inputted, whereby the commercial washing machine may be used intentionally without the payment of charges necessary to use the commercial washing machine.

In this embodiment, therefore, the power control unit, which controls main power of the machine body 30, is preferably mounted at the charge settlement device 20 such that the power can be supplied to the machine body 30 only when it is confirmed that the settlement has been made through the charge settlement device 20.

In this case, it is not necessary to continuously supply power to the machine body 30, and therefore, it is possible to reduce unnecessary power consumption. Furthermore, it is possible to prevent the charge settlement device 20 from being cut, and therefore, it is possible to prevent the commercial washing machine from being used without permission.

At this time, the charge settlement device 20 and the machine body 30 transmit and receive settlement information and information related to the progress of washing through the ports P1 to P8. An AC power source 10 may be configured such that power from the AC power source 10 is inputted to the charge settlement device 20, and the power is outputted from a port Pout of the charge settlement device 20 and inputted to a port Pin of the machine body 30 depending upon the confirmation as to whether the settlement has been made. At this time, the charge settlement device 20 may perform a controlling operation such that, when a user inputs a washing start command, and therefore, an operation start signal is inputted to the machine body 30, the power of the machine body is turned on by the power control unit, and, when all operations are completed, and therefore, an operation end signal is inputted to the machine body, the power of the machine body is turned off by the power control unit.

In the commercial washing machine with the above-stated construction, the charge settlement device 20 and the machine body 30 are assembled last. Before the assembly of the charge settlement device 20 and the machine body 30, it is preferred to inspect whether the machine body 30 can normally transmit a signal related to the washing information or not.

This is because, when the abnormality of the signal system of the machine body 30 is detected after the assembly of the charge settlement device 20 and the machine body 30, it is required to disassemble the charge settlement device 20, which is troublesome. In particular, the charge settlement device 20 is securely fixed to the machine body 30 in order to prevent users from separating the charge settlement device 20 from the machine body 30 without permission. Consequently, it is preferred to perform the inspection of the signal system of the machine body 320 before the assembly of the charge settlement device 20 and the machine body 30.

In this embodiment, therefore, an additional signal inspection assembly 60 is used to inspect the signal system of the machine body 30 before the assembly of the charge settlement device 20 and the machine body 30.

Hereinafter, the signal inspection assembly 60 will be described in detail with reference to FIG. 3.

Figure 3:
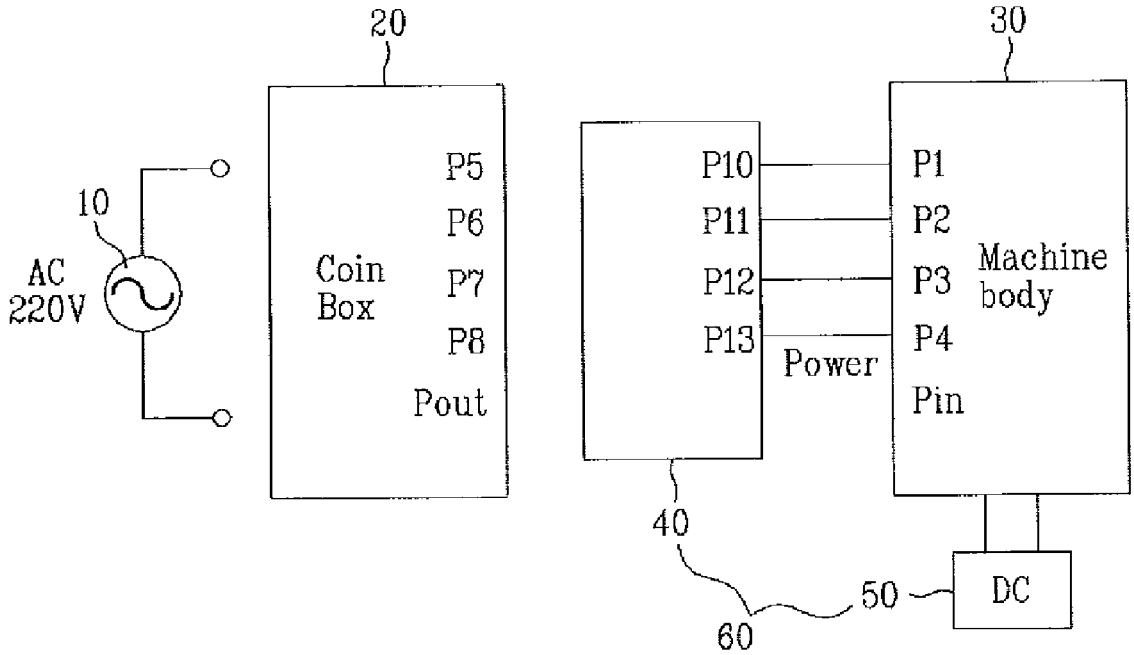
FIG. 3 is a view schematically illustrating the connection of a signal inspection apparatus to the commercial washing machine according to the present invention.

FIG. 3 is a view schematically illustrating the connection of the signal inspection assembly 60 to the commercial washing machine according to the present invention.

The signal inspection assembly 60 includes an auxiliary power supply unit 50 for supplying auxiliary power to the machine body 30.

For a commercial washing machine constructed in a structure in which the power control unit is mounted at the charge settlement device 20 as in this embodiment, it is not possible to supply power to the machine body before the assembly of the charge settlement device 20 and the machine body 30. Consequently, it is preferred to temporarily supply power to the machine body 30 through the auxiliary power supply unit 50, at a signal inspecting step, such that the machine body 30 can be driven, and therefore, a signal can be generated from the machine body 30.

In this embodiment, therefore, the auxiliary power supply unit 50, while supplies DC power sufficient only to operate the control unit of the machine body 30, is used through a directly connectable port. However, the above-mentioned auxiliary power supply unit is merely one possible example, and therefore, any kinds of auxiliary power supply units may be used so long as the auxiliary power supply units are constructed to auxiliary supply power.

Consequently, the auxiliary power supply unit 50 is connected to the machine body 30, such that the power can be supplied to the machine body 30, and the machine body 30 is driven to generate a signal related to a washing operation, even before the assembly of the charge settlement device 20 and the machine body 30.

On the other hand, the signal inspection assembly 60 includes a signal inspection apparatus 40 for inspecting a signal generated from the machine body 30.

When the machine body 30 is driven by the auxiliary power supply unit 50, the signal inspection apparatus 40 serves to inspect whether a signal is normally generated from the machine body 30 in a state in which the signal inspection apparatus 40 is mounted at the machine body 30.

At this time, the signal inspection apparatus 40 is preferably configured to be coupled to the ports of the machine body 30 at which the charge settlement device 20 is mounted such that a signal is exchanged between the charge settlement device 20 and the machine body 30. As shown in FIG. 3, the signal inspection apparatus 40 includes inspection ports P10 to P13 corresponding to the ports P1 to P4 of the machine body 30, which exchanges a signal with the charge settlement device 20, for receiving a signal generated from the machine body 30.

Figure 4:
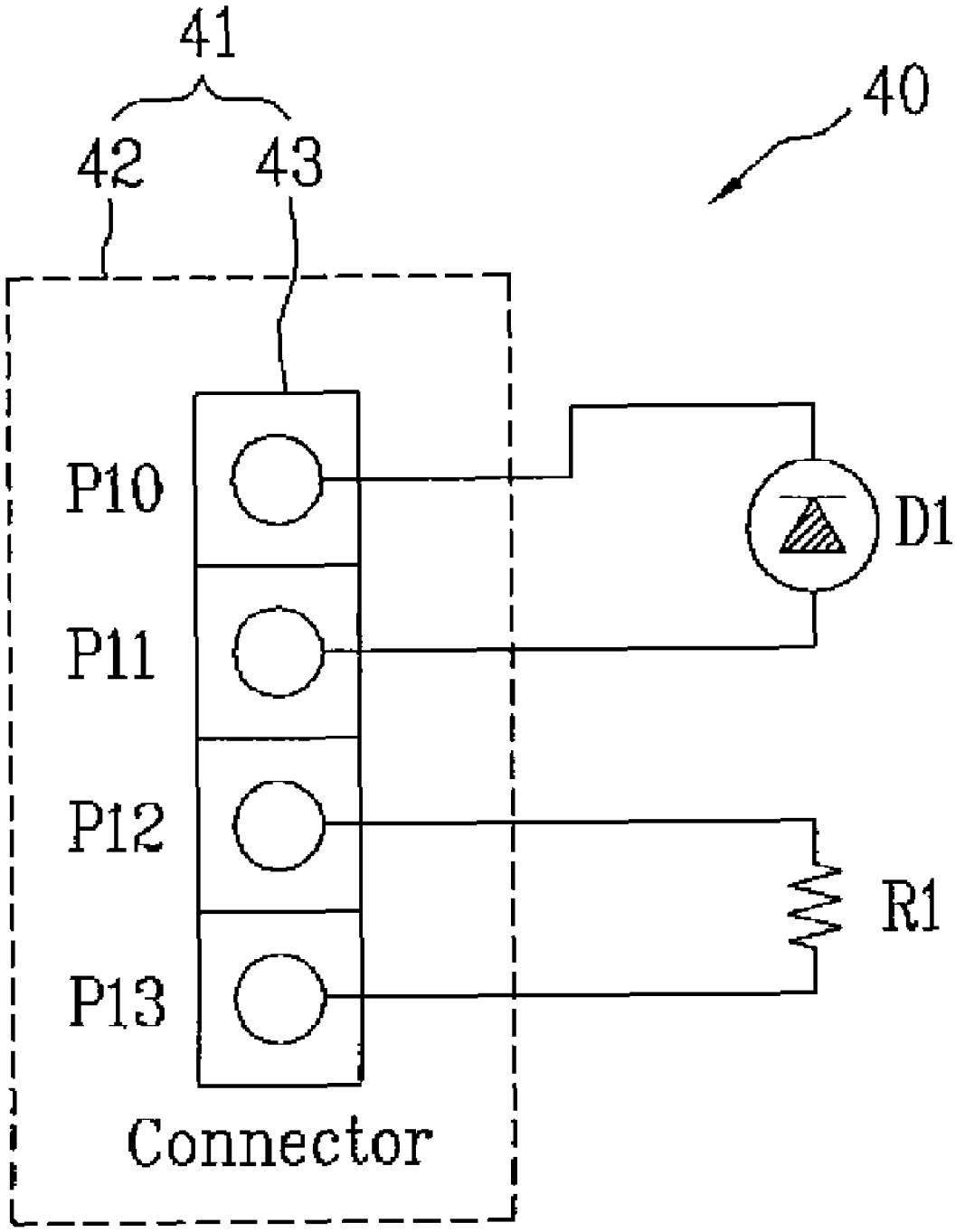
FIG. 4 is a view illustrating the construction of the signal inspection apparatus of the commercial washing machine according to the present invention.

Hereinafter, the construction of the signal inspection apparatus 40 of the commercial washing machine according to the present invention will be described in detail with reference to FIG. 4.

The signal inspection apparatus 40 includes a connector 41 coupled to the ports of the machine body 30 for receiving a signal from the machine body 30, a light emitting unit or a display unit D1 constructed to blink according to the signal received by the connector 41, and a bias resistor R1 connected to the light emitting unit D1 for adjusting the magnitude of the signal.

Preferably, the connector 41 has the same construction as a connector included in the charge settlement device 20. However, the above-mentioned construction is merely a possible example, and the construction of the connector 41 is not particularly restricted so long as the signal inspection apparatus 40 can be electrically connected to the ports of the machine body 30 by the connector 41.

In this embodiment, the connector 41 includes a case 42 forming the external appearance of the connector 41 and constructed to be coupled to the machine body 30 and inspection ports 43 electrically connected to the ports of the machine body 30 for receiving a signal.

In this embodiment, the case 42 is formed in the shape of a box, and the inspection ports 43, which are electrically connected to the corresponding ports of the machine body 30, are fixed in the case 42. At this time, the inspection ports 43 are fixed at positions corresponding to the ports of the machine body 30. Consequently, when the connector 41 is fitted to the machine body 30, the inspection ports 43 are electrically connected to the corresponding ports of the machine body 30.

The signal inspection apparatus 40 is provided to inspect only whether the signal outputted from the machine body is abnormal or not, and therefore, the number of the inspection ports 43 is not necessarily equal to that of the ports of the machine body 30. Consequently, the number of the inspection ports may be reduced according to the kinds of signals necessary to be inspected, among the signals outputted from the machine body 30.

For example, when the number of the ports of the machine body 30 is 8, but the number of signals outputted through the ports of the machine body 30 is only 2, and the other ports are provided to receive signals outputted from other devices, the connector 41 of the signal inspection apparatus 40 may include a total of four inspection ports 43.

At this time, the size of the signal inspection apparatus 40 is decided depending upon the number of the inspection ports 43. Consequently, with the reduction of the number of the inspection ports 43, the overall size of the signal inspection apparatus 40 decreases.

Here, the connector 41 may be made of polybutylene terephthalate (PBT), which can be easily handled and is suitable for both an alternating current and a direct current. According to the present invention, the connector 41 is used at a low voltage, and therefore, the connector 41 may be made of nylon, which is inexpensive.

The display unit D1 is preferably a light emitting diode, the power consumption of which is low; however, the display unit D1 may have a lamp function that is capable of emitting light by the application of a low voltage, which is a control signal. Alternatively, the display unit D1 may be replaced with a sound output element that is capable of outputting a sound, such that a user can be informed whether the signal has been received, if the function and the handling efficiency of the display unit D1 are good. Also, the display unit D1 may be constructed using a heat emitting element; however, the heat emitting element has high power consumption and is difficult for the user to detect as compared to other methods.

The bias resistor R1, which is a resistance element, may be used to distribute current such that excessive current is prevented from flowing to the display unit D1. Consequently, the bias resistor R1 and the display unit D1 are preferably connected in parallel to each other.

At this time, the resistance value of the display unit D1 may be confirmed when the display unit D1 is purchased or calculated by the measurement. Consequently, it is preferred to select a bias resistor R1 having a resistance value efficient for a rated current to flow to the display unit D1 in order to prevent the display unit D1 from being burned due to overheating.

The signal inspection apparatus 40 does not perform the same function as the charge settlement device 20. Consequently, when the signal inspection apparatus 40 receives a signal from the machine body 30, the signal inspection apparatus 40 may inform a user of whether the signal has been received by emitting light or outputting a sound instead of supplying the AC power.

The user can determine whether the control unit of the machine body 30 has been driven merely depending upon whether the display unit D1 has been turned on or off and confirm whether the signal system of the machine body 30 is abnormal by observing patterns in which the operation of the display unit D1 is changed.

On the other hand, the signal inspection apparatus 40 may include an additional microprocessor. In this case, the signal inspection apparatus 40 includes a display unit for outputting a specific message depending upon the patterns of a signal inputted from the machine body 30. For example, the message displayed on the display unit may be characters, such as "During washing" and "During spin-drying." Alternatively, the message displayed on the display unit may be pictures, which attract the interest of the user. Consequently, the signal inspection apparatus 40 can more easily confirm whether a signal is normally inputted from the machine body 30.

Hereinafter, a method of manufacturing the commercial washing machine using the signal inspection assembly according to the present invention will be described in detail.

First, the machine body 30, in which a washing operation for washing laundry is performed, and the charge settlement device 20, which allows a user to deposit charges, are separately manufactured to constitute the commercial washing machine. At this time, the machine body 30 and the charge settlement device 20 includes ports, through which a signal related to whether money has been deposited or the contents of the washing operation is exchanged between the machine body 30 and the charge settlement device 20 after the assembly of the machine body 30 and the charge settlement device 20.

Before the assembly of the machine body 30 and the charge settlement device 20, a step of inspecting a signal is carried out by the signal inspection assembly in order to determine whether a signal is normally generated from the machine body 30 according to the washing operation.

At this time, the signal inspection assembly may include the signal inspection apparatus 40 and the auxiliary power supply unit 50. As previously described, the signal inspection apparatus 40 is coupled to the ports of the machine body 30 for detecting a signal, and the auxiliary power supply unit 50 serves to supply power to the machine body 30.

Specifically, the signal inspection apparatus 40 and the auxiliary power supply unit 50 are coupled to the machine body 30, and then the machine body 30 is driven. After the machine body 30 is driven, whether a signal is normally outputted from the machine body 30 is detected by the signal inspection apparatus 40.

At this time, the step of detecting whether the signal is abnormal preferably includes inputting the signal from the machine body 30 to the signal inspection apparatus 40 and displaying whether the signal is abnormal depending on the inputted signal such that a user is informed of whether the signal is abnormal. When no signal has been detected, the display step may not be performed or a specific indication informing the abnormality may be provided such that the user can easily recognize that no signal has been detected.

When it is determined that the signal system of the machine body 30 is normal, the signal inspection assembly is removed, and the charge settlement device 20 is coupled to the machine body 30 to constitute the commercial washing machine.

According to the present invention, as described above, it is possible to inspect whether the signal system of the machine body 30 even before the charge settlement device 20 is mounted at the machine body 30. Consequently, the present invention solves the inconvenience caused from the conventional art, in which, when an abnormality is inspected, after the charge settlement device 20 is mounted at the machine body 30, it is required to separate the charge settlement device 20 from the machine body 30.

As described above, this embodiment is applied to the manufacture of the commercial washing machine; however, this embodiment may be also applied to the inspection or repair of the commercial washing machine.

As apparent from the above description, the power control unit is mounted at the charge settlement device, and therefore, power is supplied to the machine body of the commercial washing machine after the settlement of charges is made. Consequently, the present invention has the effect of preventing unnecessary power consumption.

Also, it is possible to inspect whether the machine body is abnormal even before the charge settlement device is mounted to the machine body, Consequently, the present invention has the effect of solving inconvenience caused when the charge settlement device is separated from the machine body due to the discovery of abnormality of the machine body after the assembly of the charge settlement device and the machine body.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A signal inspection assembly of a commercial washing machine, comprising:

an auxiliary power supply unit coupled to a machine body of the commercial washing machine for temporarily supplying power to the machine body, instead of a primary power supply unit mainly supplying the power to the machine body; and a signal inspection apparatus coupled to a position where a charge settlement device is mounted to the machine body for detecting whether signals generated from the machine body are abnormal, the signal inspection apparatus including:

a connector configured to be connected to ports of the machine body, through which signal exchanges between the machine body and a charge settlement device are achieved; and a display unit for displaying whether the signals inputted through the ports are abnormal.

2. The signal inspection assembly according to claim 1, wherein the connector includes a box-shaped case and inspection ports electrically connected to the ports of the machine body, and the inspection ports are fixed in the case such that the inspection ports correspond to the ports of the machine body, whereby the inspection ports are connected to the corresponding ports of the machine body in a batch fashion when the connector is fitted to the machine body.

3. The signal inspection assembly according to claim 1, wherein the display unit includes a light emitting diode.

* * * * *